US010895051B2

(12) United States Patent
Van den Noort

(10) Patent No.: US 10,895,051 B2
(45) Date of Patent: Jan. 19, 2021

(54) WAVE BARRIER, BARRIER ASSEMBLY, FLOOD BARRIER, AND METHOD

(71) Applicant: Van den Noort Innovations B.V., Kampen (NL)

(72) Inventor: Michiel Van den Noort, Kampen (NL)

(73) Assignee: Van den Noort Innovations B.V., Kampen (NL)

( * ) Notice: Subject to any disclaimer, the term of this patent is extended or adjusted under 35 U.S.C. 154(b) by 0 days.

(21) Appl. No.: 16/325,947

(22) PCT Filed: Aug. 18, 2017

(86) PCT No.: PCT/NL2017/050546
§ 371 (c)(1),
(2) Date: Feb. 15, 2019

(87) PCT Pub. No.: WO2018/034569
PCT Pub. Date: Feb. 22, 2018

(65) Prior Publication Data

US 2019/0177940 A1 Jun. 13, 2019

(30) Foreign Application Priority Data

Aug. 18, 2016 (NL) ..... 2017335

(51) Int. Cl.
*E02B 3/06* (2006.01)
*E02B 3/10* (2006.01)

(52) U.S. Cl.
CPC ..... *E02B 3/062* (2013.01); *E02B 3/104* (2013.01)

(58) Field of Classification Search
CPC . E02B 3/104; E02B 7/50; E02B 7/205; E02B 7/28; E02B 3/062
USPC ..... 405/23, 26, 31, 63, 65, 86, 87, 92, 93, 405/96, 103, 104, 106, 107
See application file for complete search history.

(56) References Cited

U.S. PATENT DOCUMENTS 5,725,326 A * 3/1998 Van den Noort ..... E02B 3/104 405/104
6,338,594 B1 * 1/2002 Adler ..... B82Y 10/00 405/104
7,972,081 B2 * 7/2011 Linares ..... E02B 3/104 405/105

(Continued)

FOREIGN PATENT DOCUMENTS

EP 0684342 A2 11/1995
JP 2007239233 A 9/2007

(Continued)

*Primary Examiner* — Carib A Oquendo
(74) *Attorney, Agent, or Firm* — The Webb Law Firm

(57) ABSTRACT

The present invention relates to a self-raising wave barrier for providing an alleviation of a load due to wave action from a body of water on the side of the wave barrier remote from the body of water. The barrier includes a series of barrier assemblies providing alleviation of the load due to the wave action. Each barrier assembly includes a holder for a wave barrier element which is anchored to a bottom of the body of water or a surface adjacent to the body of water, a wave barrier element arrangeable movably over a path of movement in the holder between a lower rest state and a higher active state, and holding means for holding and/or stopping the wave barrier element in the higher active state.

26 Claims, 5 Drawing Sheets

(56) References Cited

U.S. PATENT DOCUMENTS

| | | | | |
|---|---|---|---|---|
| 2009/0169302 | A1* | 7/2009 | Alpern | E02B 3/104 405/33 |
| 2009/0220301 | A1* | 9/2009 | Miyao | E02B 7/205 405/21 |
| 2011/0110722 | A1 | 5/2011 | van den Noort | |
| 2011/0268506 | A1* | 11/2011 | Thornbury | E02B 3/104 405/118 |
| 2015/0117952 | A1* | 4/2015 | Gujer | E02B 3/104 405/96 |
| 2016/0201281 | A1* | 7/2016 | Roy | E02B 3/104 405/107 |
| 2016/0244927 | A1* | 8/2016 | Adler | E02B 7/26 |

FOREIGN PATENT DOCUMENTS

| | | | |
|---|---|---|---|
| JP | 201387574 | A | 5/2013 |
| WO | 2009139622 | A1 | 11/2009 |

* cited by examiner

WAVE BARRIER, BARRIER ASSEMBLY, FLOOD BARRIER, AND METHOD

CROSS-REFERENCE TO RELATED APPLICATIONS

This application is the United States national phase of International Application No. PCT/NL2017/050546 filed Aug. 18, 2017, and claims priority to Dutch Patent Application No. 2017335 filed Aug. 18, 2016, the disclosure of each of which is hereby incorporated by reference in its entirety.

BACKGROUND OF THE INVENTION

Field of the Invention

The present invention relates to a self-raising wave barrier for providing an alleviation of a load due to wave action from a body of water, such as sea, on the side of the wave barrier remote from the body of water. The present invention also relates to a barrier assembly arrangeable in a body of water as protective barrier against floating objects, such as drifting objects. The present invention also relates to a flood barrier system for arranging thereof on a body of water, such as a sea, comprising a wave barrier according to the present invention and a self-closing flood barrier. The present invention further relates to a method for providing protection against wave action.

Description of Related Art

Wave action and current cause a number of problems. One problem is that wave action can damage a shore or that wave action can damage objects constructed on the shore. A further problem is that wave action can damage a self-closing flood barrier or can at least exert a load thereon which can limit the reliability of such a self-closing flood barrier. A further problem is that wave action has a direct effect on a shore or objects on or at the shore. Even though such problems can be solved by erecting large engineering structures close to shore which can withstand wave action, such a solution only solves the problem at high cost or with the drawback that such engineering structures are visible and for instance detract from the way in which the shore is perceived.

SUMMARY OF THE INVENTION

In order to obviate such drawbacks the present invention provides a self-raising wave barrier for providing an alleviation of a load due to wave action from a body of water, such as a sea, on the side of the wave barrier remote from the body of water, the wave barrier comprising:

- a series of barrier assemblies for providing the alleviation of the load due to the wave action, each barrier assembly comprising:
- a holder for holding a wave barrier element which is anchored to a bottom of the body of water or a surface adjacent to the body of water,
- a wave barrier element arrangeable movably over a path of movement in the holder between a lower rest state and a higher active state,
- holding means for holding and/or stopping the wave barrier element in the higher active state, wherein
- the respective wave barrier elements of the series of barrier assemblies operate in the active state for the purpose of breaking the wave action providing the alleviation of the load due to the wave action on the basis of a situationally predetermined ratio of wave barrier elements and throughflow space therebetween.

Such a self-raising wave barrier according to the present invention provides a number of advantages. A significant advantage is that the self-raising wave barrier falls outside the field of vision in the rest state and is only visible in the active state, which is only necessary in the case of a certain measure of wave action. The following advantage is particularly important in combination with the first one. In the active state the self-raising wave barrier provides the advantage that the horizontal force of the wave, or the horizontal inflow of water with the associated impulse force, is prevented. This is because the water from the incoming wave is partially held back by the series of wave barrier elements.

The advantage provided here is that the amount of water which the wave action pushes through between the wave barrier elements is also held back to significant extent or at least partially by the same wave barrier elements, or obstructed in outflow. A buffer water mass is hereby created behind the wave barrier elements, as seen from the body of water, in the buffer space between the wave barrier elements and the shore or flood barrier, such as self-closing flood barrier, lying behind.

A suitable choice of the mutual distance between wave barrier elements is that a suitable buffer water mass remains behind in this water buffer between two successive incoming waves. This buffer water mass provides two advantages. Firstly, a part of the water from the first wave does not flow back, or does so slowly, into the body of water to feed a subsequent wave.

The amount of incoming energy from the subsequent wave is hereby relatively small since on the one hand the water level on the body of water side of the flood barrier is relatively low, this water level being first supplemented by the wave, which slows the wave, and on the other the amount of energy from the remaining incoming wave at the location of the flood barrier is slowed by the part of the buffer water mass still flowing out.

The mass of the buffer water mass present also absorbs energy from the wave, which energy is therefore absorbed, and the energy from the wave is not available to make contact with the shoreline and structures present thereon, such as a self-closing flood barrier.

In a first preferred embodiment according to the present invention the holding means operate for the purpose of providing a lateral stability and/or fixation of the wave barrier element relative to the respective holder thereof. Hereby provided as advantage is that the holding means stabilize the wave barrier element in advantageous manner relative to the holder. Damage due to for instance shifting of the wave barrier element in the holder is hereby prevented. The wave barrier element is also prevented from bumping against the holder.

The holding means more preferably operate for the purpose of providing an end of the path of movement on the side of the active state thereof. The holding means hereby also operate as a stop which ends the upward movement of the wave barrier element.

A preferred practical development of the holding means preferably relates to holding means comprising:

- an upper stop member arranged on the holder,
- a lower stop member arranged on the wave barrier element, and at least one clamping member for arranging thereof and for clamping thereof in the active state between the upper stop member and the lower stop member.

The upper stop member holds the lower stop member arranged in the holder and limits the upward movement of the wave barrier element. The clamping member provides a clamping action here at least providing for a horizontal fixation against rocking and jolting of the wave barrier element relative to the holder under the influence of the substantially horizontal wave action.

The holding means more preferably comprise a spacer for arranging thereof between the upper stop member and the lower stop member. Such a spacer provides a distance, and thereby an arm, for improved absorption of the horizontal forces.

Such a variant is further improved in the preferred variant wherein the spacer is arranged between at least an upper clamping member and at least a lower clamping member. A distribution of force is provided here between the lower clamping member and the upper clamping member which both fix the wave barrier element. It is generally the case here that the greater the distance, the greater the forces which can be absorbed.

The clamping member is more preferably deformable here, preferably from a substantially round cross-sectional shape to a substantially oval cross-sectional shape. The upward force of the wave barrier element deforms the shape of the clamping member by compressing it. The horizontal distance from the centre of the clamping member as seen in the height hereby becomes greater, whereby it is clamped between the inner wall of the holder and the wave barrier element.

In specifically practical manner the clamping member is preferably embodied here as a substantially annular hose arrangeable round the wave barrier element. For clamping purposes the upper clamping member and the lower clamping member are deformable to a situation in which the upper side and the underside are urged toward each other and, as seen in cross-section, the inner and outer side are urged apart. Depending on the anticipated forces, one or more of such clamping members can be applied with a wall thickness adjustable within the context of this description for the purpose of absorbing forces.

In a further preferred embodiment the holding means alternatively comprise positioning members for positioning the wave barrier element relative to the holder. Such positioning members operate as a positioning stop. The positioning member on the holder and the positioning member on the wave barrier element more preferably comprise for this purpose inclining surfaces co-acting with each other in the active state. These inclining surfaces operate in advantageous manner both as stop and as centering means for the wave barrier element relative to the holder.

According to a further preferred embodiment, the wave barrier comprises a closure for closing the holder, preferably arranged on the upper side of the wave barrier element. Such a closure can be a cover over which it is possible to walk or drive. The wave barrier, at least in the rest state, is hereby also concealed almost completely from view. The closure is preferably suitable here for suspending of the wave barrier element therefrom. The wave barrier element is situated here in the holder and the wave barrier is in the rest state.

A way of providing the self-raising in advantageous manner is that the wave barrier element is suitable for floating on water so that it is raised on water to be admitted into the holder.

The wave barrier element more preferably has a tubular form, such as being substantially circular in top view. This provides the advantage that great forces can be withstood. Depending on the situation in which the wave barrier is applied, other cross-sectional shapes in top view are possible, such as regular geometrical forms, although profiles influencing flow, such as wing profiles or curved surfaces, are also provided.

In side view a surface of a wave barrier element preferably has a width here of between 10 centimetres and 5 metres, preferably a width of between 40 cm and 1.60 m, preferably a width between 40 cm and 1.20 m, more preferably a width between 60 cm and 1.20 m, more preferably a width between 80 cm and 1 m, more preferably a width between 80 cm and 2.5 m, more preferably a width between 1 m and 2 m. In addition hereto, the mutual distance is more preferably in the range of 1 cm to 1 m, preferably between 5 cm and 80 cm, more preferably between 5 cm and 50 cm, more preferably between 5 cm and 30 cm, more preferably between 5 cm and 20 cm, and is more preferably substantially 10 cm. A minimal distance is provided by a wall thickness of the holder or the wall thickness of two holders arranged against each other. An optimal or an optimal average ratio has to be determined per situation of use within the context of the present invention.

The holder more preferably imparts lateral strength for withstanding the load of the wave action. The strength of the holder, as well as a foundation thereof, has to be dimensioned within the context of the present invention subject to the forces occurring in a specific situation.

In the rest state the wave barrier elements find protection in the holder and/or are arranged substantially wholly therein. The useful life of a wave barrier is hereby influenced positively to a significant extent by protection of the elements.

The mutual distance between adjacent wave barrier elements is preferably smaller than a surface in side view of the respective wave barrier elements. A plurality of the holders are more preferably integrated into a structural unit in the series of barrier assemblies.

For the purpose of controlling the transition from the rest state to the active state the wave barrier more preferably comprises a liquid inlet assembly for admitting liquid, such as water from the body of water, into the holder when the water level or a wave action level reaches a predetermined threshold. It is for instance hereby possible to realize that the wave barrier elements are forced upward by water.

For the durability and the operational reliability of the wave barrier the liquid inlet assembly more preferably comprises a buffer pit for buffering the water and/or for preventing contamination in the holder and/or draining contamination from the holder.

A further aspect according to the present invention relates to a barrier assembly according to the present invention arrangeable in a body of water as protective barrier against floating objects such as drifting objects. This prevents such floating objects damaging objects lying behind. A self-closing flood barrier for instance, but also for instance engineering structures or buildings constructed on the shoreline or moored houseboats are hereby protected.

A further aspect according to the present invention relates to a flood barrier system for arrangement thereof on a body of water, such as a sea, comprising a wave barrier according to one or more of the foregoing claims and a self-closing flood barrier comprising:

a chamber for holding a sheet pile which is anchored to a bottom of the body of water or a surface adjacent to the body of water, a sheet pile which is arrangeable movably over a path of movement in the chamber between a lower rest state and a higher active state, wherein the wave barrier is arranged on the side of the body of water relative to the self-closing flood barrier for the purpose of providing protection of the self-closing flood barrier against wave action.

A significant advantage of this aspect is that a self-closing flood barrier is protected against wave action, but of course also against the stated free-floating or drifting objects.

Such a flood barrier system preferably comprises a combined liquid inlet assembly for the wave barrier and the self-closing flood barrier. The activation of the wave barrier and the flood barrier can hereby be realized in advantageous manner.

A further aspect of the present invention relates to a method for providing protection against wave action, wherein:

water forced from a body of water by an incoming wave is allowed through in slowed manner by means of wave barrier elements of a wave barrier according to one or more of the foregoing claims to a buffer space on the body of water side bounded by the wave barrier elements of the wave barrier, water admitted into the buffer space and decelerated by the wave barrier elements of the wave barrier is allowed to flow in slowed manner in the direction of the body of water, whereby a mass of buffer water is created in the buffer space, the mass of buffer water provides counter-mass against a subsequent incoming wave.

Such an aspect provides advantages as described with reference to the above described aspects according to the present invention.

BRIEF DESCRIPTION OF THE DRAWINGS

Further advantages, features and details of the present invention will be described in greater detail hereinbelow on the basis of one or more preferred embodiments with reference to the accompanying figures. Similar, though not necessarily identical components of different preferred embodiments are designated with the same reference numerals.

DESCRIPTION OF THE INVENTION

Figure 1:
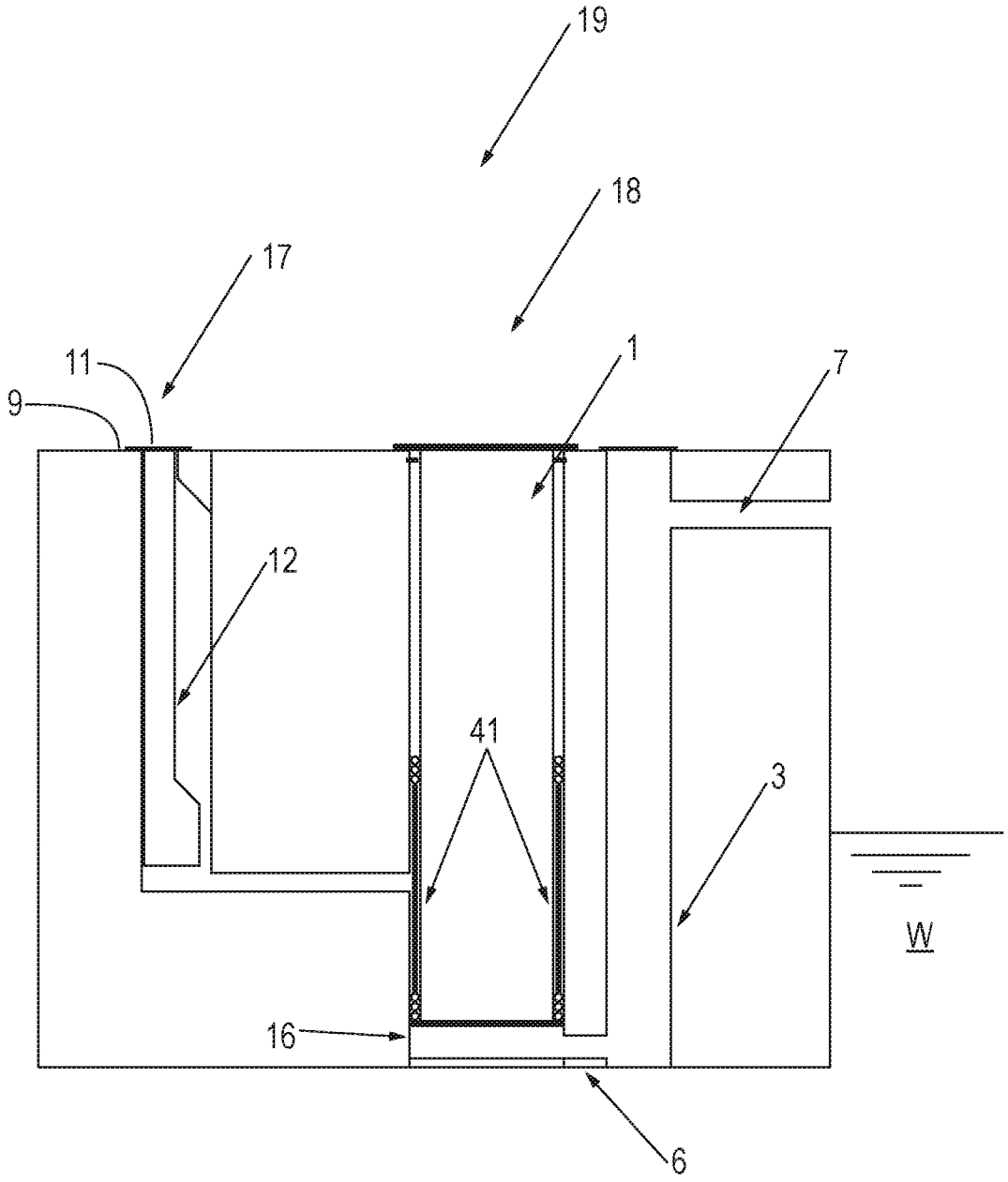
FIG. 1 is a schematic cross-sectional side view of a first preferred embodiment according to the present invention in a rest state.
Figure 2:
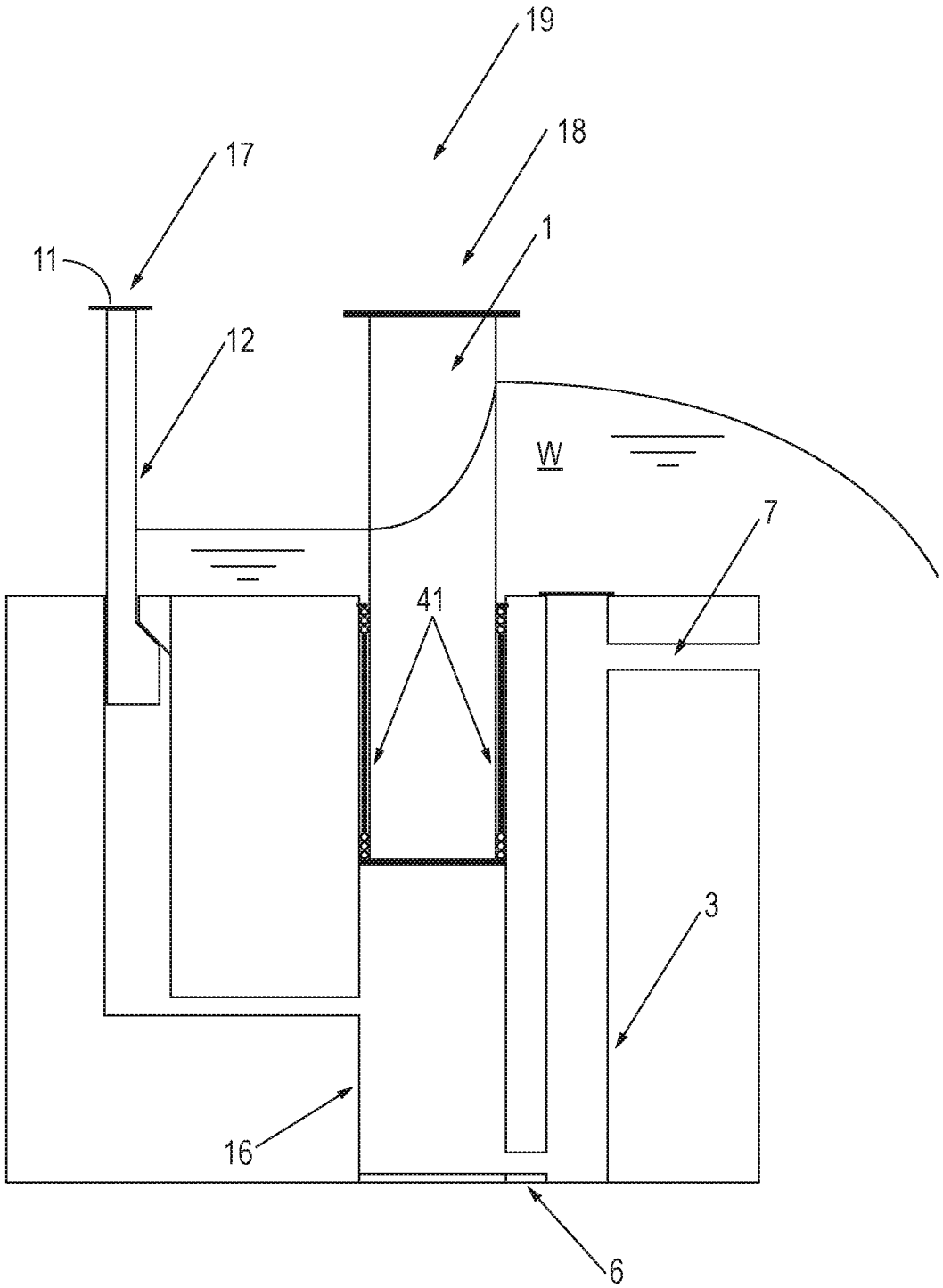
FIG. 2 is a schematic view of this preferred embodiment in an active state.

A first preferred embodiment (FIG. 1) according to the present invention relates to a combination 19 of a wave barrier 18 and a self-closing flood barrier 17. This comprises wave barrier element 1 which is arranged in a holder 16. In the rest state the wave barrier element is suspended from cover 11 and is located as such arranged downward in the holder. The body of water W has a height which corresponds to the rest state of the wave barrier. A supply channel 7 provides access for the water to a pit 3 when the water reaches a determined height. When this height of channel 7 is reached, the pit fills and the water then flows via channel 6 into holder 16. Due to the upward pressure of the water the wave barrier element will float upward, thereby taking on the active state function.

Figure 3:
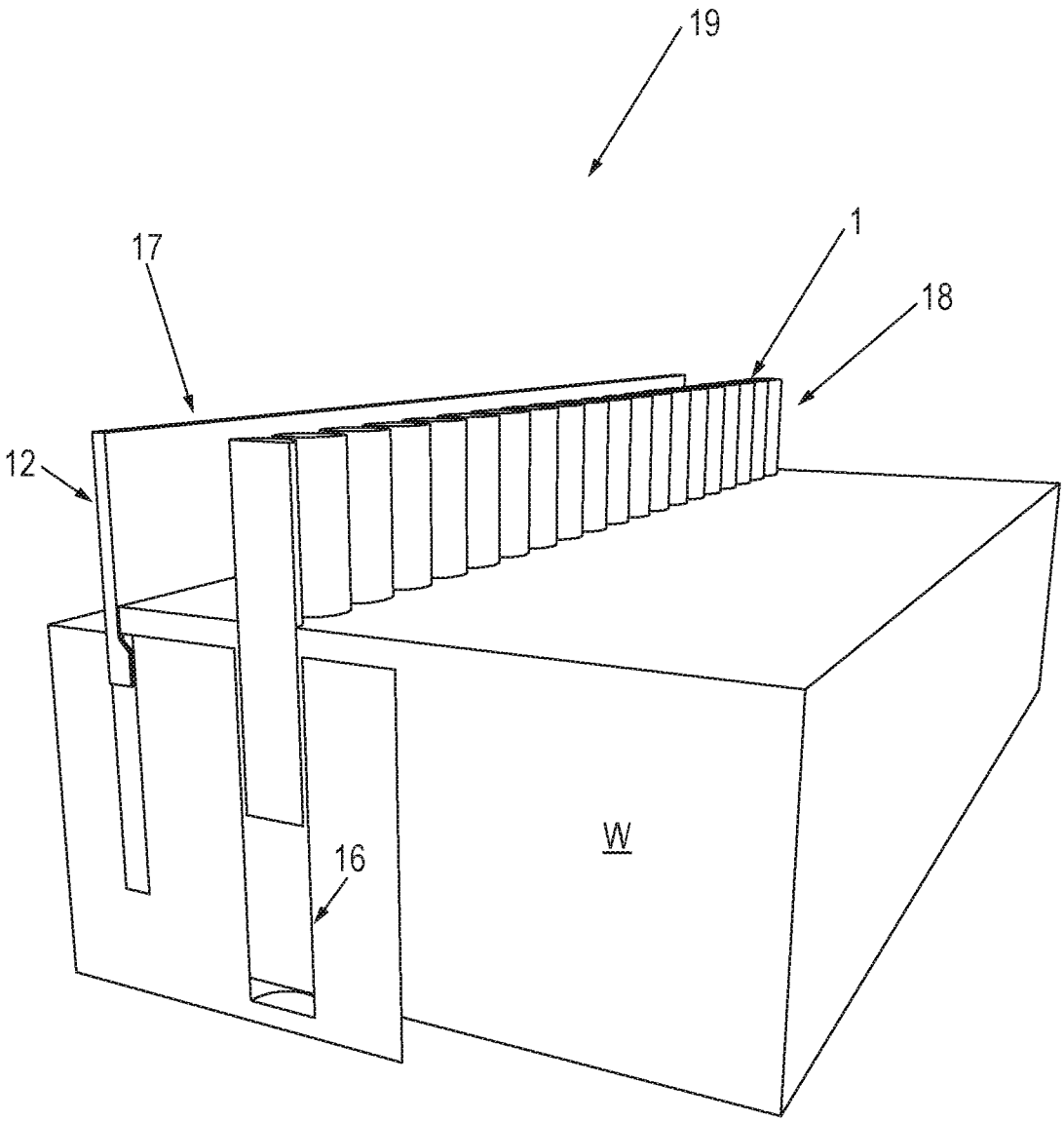
FIG. 3 is a schematic perspective view of the preferred embodiment according to FIGS. 1 and 2.

This operation is clearly shown in FIG. 3 where a series of wave barrier elements is disposed upward. Incoming waves from the body of water are broken by the wave barrier elements 1 in a manner as described above.

This preferred embodiment also comprises the self-closing flood barrier 17. This comprises a vertical wall 12 which is likewise forced upward until it reaches a stop 9 due to the water coming from pit 3. The operation of such a flood barrier is public domain and such a flood barrier is available in many variants. The flood barrier is screened in the inactive state by a cover 11.

Figure 4:
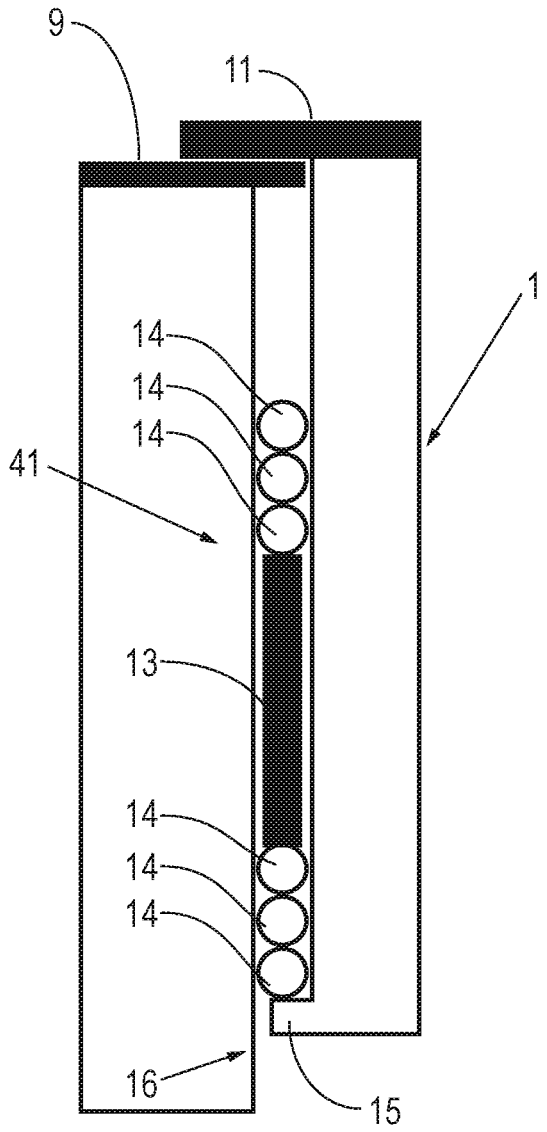
FIG. 4 is a schematic view of a detail of a further preferred embodiment in a rest state.
Figure 5:
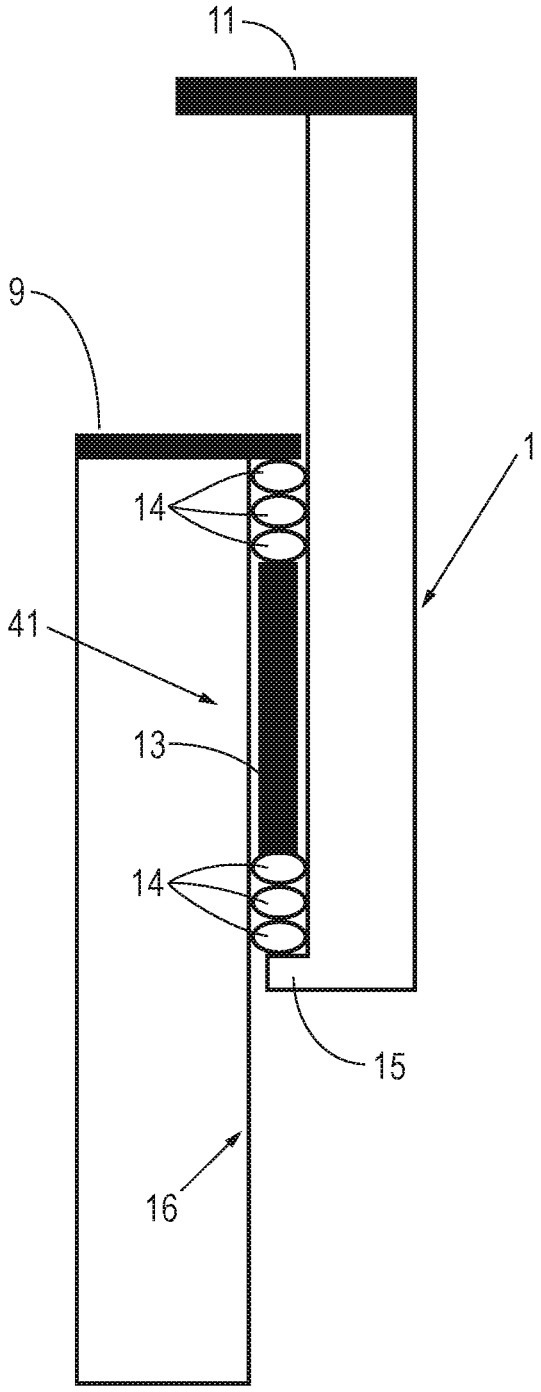
FIG. 5 shows the detail of FIG. 4 in an active state.

The stability of the wave barrier element is provided by holding means 41 as shown in FIGS. 4 and 5. These holding means are annular hoses 14 arranged round the wave barrier element with a spacer 13 between lower and upper annular hoses. In the rest state the annular hoses have a round cross-section and in the active state they are compressed between stop 15 of the wave barrier element and stop 9 of the holder. This creates a clamping effect between the holder and the wave barrier element on both the upper side and the underside, as described above.

Cover 11 is preferably provided per wave barrier element. It is however equally possible for the cover to couple a group of wave barrier elements. It is advantageous that a wave barrier element according to these aspects of the preferred embodiment can be placed in or taken out of the holder individually or per group for maintenance purposes. A robust and maintenance-friendly wave barrier is hereby provided. The rings are more preferably dimensioned, such as by means of the diameter or wall thickness, such that the upper ones impart clamping action from the top downward sooner than the lower ones when the wave barrier element is raised, so that the lower ones can still move upward while the upper ones are already compressed.

Figure 6:
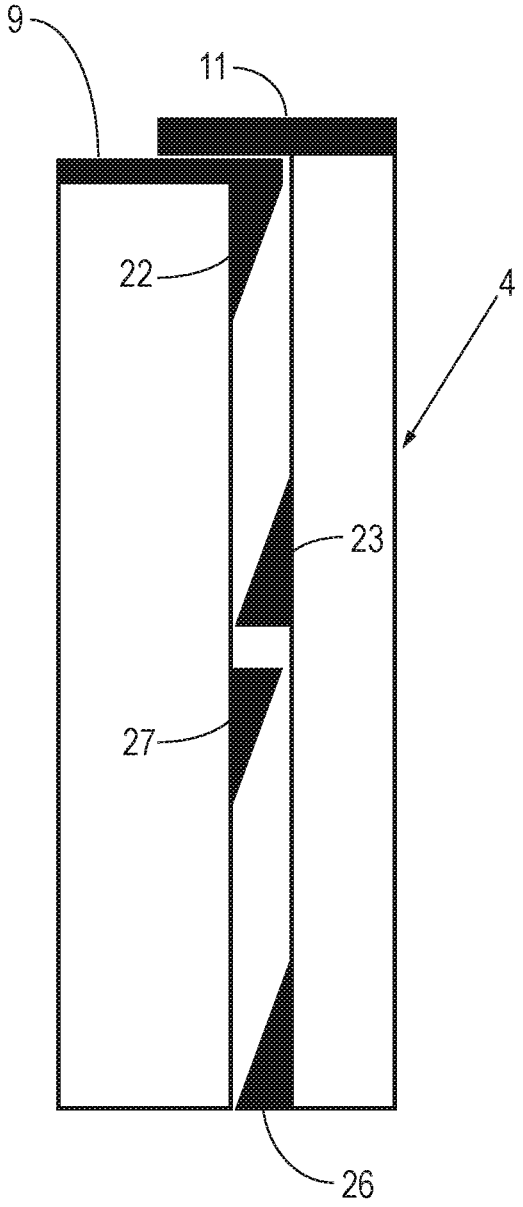
FIG. 6 is a schematic view of a detail of a further preferred embodiment in a rest state.
Figure 7:
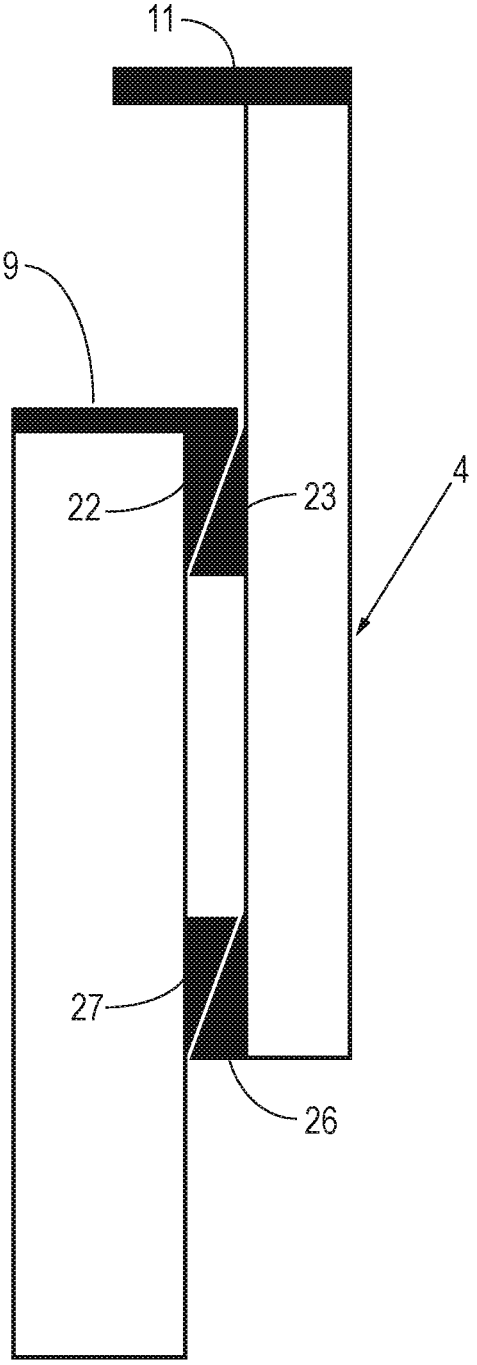
FIG. 7 shows the detail of FIG. 6 in an active state.

The preferred embodiment according to FIGS. 6 and 7 provides an alternative way of fixing the holder in the active state. Positioning members 23, 26 are arranged on wave barrier element 4. Respective support elements 22, 27 are arranged on the holder. A centering action is provided by the co-acting surfaces when the wave barrier element moves upward from the rest state to the active state.

In top view the positioning members can be arranged in annular form on respectively the inner wall of the holder and the outer wall of the wave barrier element. In alternative manner the positioning members are arranged in a discontinuously annular form. It is hereby possible to respectively place and lift the wave barrier element with the positioning members mounted thereon into and out of the holder, for instance for maintenance. In a rotational position as seen along a vertical axis there is a situation here in which the positioning members arranged on the holder and the positioning members arranged on the wave barrier element can pass each other axially, and in a rotating position the situation where they engage each other operatively for the operation as positioning member.

A surface adjacent to a body of water according to this document is defined as a surface which can be flooded by the body of water. Such a surface can directly adjoin the body of water or, within the context of this document, be present some distance therefrom.

The present invention has been described in the foregoing on the basis of several preferred embodiments. Different aspects of different embodiments are deemed described in combination with each other, wherein all combinations which can be deemed by a skilled person in the field as falling within the scope of the invention on the basis of reading of this document are included. These preferred embodiments are not limitative for the scope of protection of this document. The rights sought are defined in the appended claims.

The invention claimed is:

1. Self-raising wave barrier for providing an alleviation of a load due to wave action from a body of water on a side of the wave barrier remote from the body of water, the wave barrier comprising:

a series of barrier assemblies for providing the alleviation of the load due to the wave action, each barrier assembly comprising:

a holder for holding a wave barrier element which is anchored to a bottom of the body of water or a surface adjacent to the body of water, the wave barrier element arrangeable movably over a path of movement in the holder between a lower rest state and a higher active state, holding means for holding and/or stopping the wave barrier element in the higher active state, wherein the respective wave barrier elements of the series of barrier assemblies operate in the active state for the purpose of breaking the wave action providing the alleviation of the load due to the wave action on the basis of a situationally predetermined ratio of wave barrier elements and throughflow space therebetween, a flood barrier adjacent to the wave barrier, and wherein the wave barrier is arranged with the flood barrier to create a buffer space therebetween to provide a buffer water mass behind the wave barrier elements as seen from the body of water, the buffer water mass absorbing energy of a wave and the buffer water being prevented from feeding a subsequent wave thereby protecting the flood barrier or a shore lying there behind.

2. The self-raising wave barrier as claimed in claim 1, wherein the holding means operate for the purpose of providing a lateral stability and/or fixation of the wave barrier element relative to the respective holder thereof.

3. The self-raising wave barrier as claimed in claim 1, wherein the holding means operate for the purpose of providing an end of the path of movement on the side of the active state thereof.

4. The self-raising wave barrier as claimed in claim 1, the holding means comprising:

an upper stop member arranged on the holder, a lower stop member arranged on the wave barrier element, and at least one clamping member for arranging thereof and for clamping thereof in the active state between the upper stop member and the lower stop member.

5. The self-raising wave barrier as claimed in claim 4, wherein the holding means comprise a spacer for arranging thereof between the upper stop member and the lower stop member.

6. The self-raising wave barrier as claimed in claim 4, wherein a spacer is arranged in the holding means between at least an upper clamping member and at least a lower clamping member.

7. The self-raising wave barrier as claimed in claim 4, wherein the clamping member is deformable, preferably from a substantially round cross-sectional shape to a substantially oval cross-sectional shape.

8. The self-raising wave barrier as claimed in claim 4, wherein the clamping member is embodied as a substantially annular hose arrangeable round the wave barrier element.

9. The self-raising wave barrier as claimed in claim 1, wherein the holding means comprises positioning members for positioning the wave barrier element relative to the holder.

10. The self-raising wave barrier as claimed in claim 9, wherein the positioning members are centering members wherein the positioning member on the holder and the positioning member on the wave barrier element comprise inclining surfaces co-acting with each other in the active state.

11. The self-raising wave barrier as claimed in claim 1, comprising a closure for closing the holder, preferably arranged on the upper side of the wave barrier element.

12. The self-raising wave barrier as claimed in claim 11, wherein the closure is suitable for suspending of the wave barrier element therefrom.

13. The self-raising wave barrier as claimed in claim 1, wherein the wave barrier element is suitable for floating on water so that it is raised on water to be admitted into the holder.

14. The self-raising wave barrier as claimed in claim 1, wherein the wave barrier element has a tubular form.

15. The self-raising wave barrier as claimed in claim 1, wherein in side view a surface of a wave barrier element has a width of between 10 centimetres and 5 metres.

16. The self-raising wave barrier as claimed in claim 1, wherein the mutual distance lies in the range of 1 cm to 1 m.

17. The self-raising wave barrier as claimed in claim 1, wherein the holder imparts lateral strength for withstanding the load of the wave action.

18. The self-raising wave barrier as claimed in claim 1, wherein in the rest state the wave barrier elements find protection in the holder and/or are arranged substantially wholly therein.

19. The self-raising wave barrier as claimed in claim 1, wherein the mutual distance between adjacent wave barrier elements is smaller than a surface in side view of the respective wave barrier elements.

20. The self-raising wave barrier as claimed in claim 1, wherein a plurality of the holders are integrated into a structural unit in the series of barrier assemblies.

21. The self-raising wave barrier as claimed in claim 1, comprising a liquid inlet assembly for admitting liquid into the holder when the water level or a wave action level reaches a predetermined threshold.

22. The self-raising wave barrier as claimed in claim 21, wherein the liquid inlet assembly comprises a buffer pit for buffering the water and/or for preventing contamination in the holder and/or draining contamination from the holder.

23. The barrier assembly as claimed in claim 1 arrangeable in a body of water as protective barrier against floating objects.

24. A flood barrier system for arrangement thereof on a body of water comprising a self-leveling wave barrier as claimed in claim 1 and a self-closing flood barrier comprising:

a chamber for holding a sheet pile which is anchored to a bottom of the body of water or a surface adjacent to the body of water, and the sheet pile which is arrangeable movably over a path of movement in the chamber between a lower rest state and a higher active state, wherein the wave barrier is arranged on the side of the body of water relative to the self-closing flood barrier for the purpose of providing protection of the self-closing flood barrier against wave action.

25. The flood barrier system as claimed in claim 24 comprising a combined liquid inlet assembly for the wave barrier and the self-closing flood barrier.

26. A method for providing protection against wave action, wherein:

water forced from a body of water by an incoming wave is allowed through in slowed manner by means of wave barrier elements of a wave barrier as claimed in claim 1 to a buffer space on the body of water side bounded by the wave barrier elements of the wave barrier, water admitted into the buffer space and decelerated by the wave barrier elements of the wave barrier is allowed to flow in slowed manner in the direction of the body of water, whereby a mass of buffer water is created in the buffer space, and the mass of buffer water provides counter-mass against a subsequent incoming wave.

* * * * *